US007298089B2

(12) United States Patent
Nishida

(10) Patent No.: US 7,298,089 B2
(45) Date of Patent: Nov. 20, 2007

(54) HIGH-PRESSURE DISCHARGE LAMP

(75) Inventor: Kazuhisa Nishida, Tokyo (JP)

(73) Assignee: NEC Corporation, Tokyo (JP)

( * ) Notice: Subject to any disclaimer, the term of this patent is extended or adjusted under 35 U.S.C. 154(b) by 202 days.

(21) Appl. No.: 10/840,362

(22) Filed: May 7, 2004

(65) Prior Publication Data

US 2005/0007022 A1 Jan. 13, 2005

(30) Foreign Application Priority Data

May 9, 2003 (JP) ..... 2003-131552

(51) Int. Cl.
*H00J 61/30* (2006.01)

(52) U.S. Cl. ..... 313/639; 313/638; 313/571; 313/572

(58) Field of Classification Search ..... 313/638–639, 313/640–642, 643, 571, 111–117, 569–570, 313/572–573, 576; 445/24, 26, 29
See application file for complete search history.

(56) References Cited

U.S. PATENT DOCUMENTS 3,719,853 A * 3/1973 Sugano et al. ..... 313/579
5,323,085 A * 6/1994 Genz ..... 313/570
5,451,838 A * 9/1995 Kawai ..... 313/638
5,572,091 A * 11/1996 Langer et al. ..... 313/636
5,594,302 A * 1/1997 Yakub et al. ..... 313/642
5,929,563 A * 7/1999 Genz ..... 313/571
2002/0017860 A1 * 2/2002 Nishida et al. ..... 313/568

FOREIGN PATENT DOCUMENTS

| | | |
|---|---|---|
| JP | 2-148561 | 6/1990 |
| JP | 2829339 | 9/1998 |
| JP | 11-149899 | 6/1999 |
| JP | 2001-256918 | 9/2001 |
| JP | 2002-25500 | 1/2002 |
| JP | 2002-352772 | 12/2002 |

* cited by examiner

*Primary Examiner*—Joseph Williams
*Assistant Examiner*—Hana Asmat Sanei
(74) *Attorney, Agent, or Firm*—Young & Thompson

(57) ABSTRACT

A high-pressure discharge lamp has a lamp bulb of silica glass encapsulating mercury, an inactive gas, and a mixed halogen gas containing at least two halogen gases, and at least a pair of electrodes disposed in the lamp bulb in confronting relation to each other. The type and content of a primary halogen gas whose content is the greatest in the mixed halogen gas are determined based on a bulb wall load.

2 Claims, 3 Drawing Sheets

HIGH-PRESSURE DISCHARGE LAMP

BACKGROUND OF THE INVENTION

1. Field of the Invention

The present invention relates to a high-pressure discharge lamp for emitting light due to a plasma discharge in the presence of a mercury gas atmosphere, and a method of manufacturing such a high-pressure discharge lamp.

2. Description of the Related Art

General high-pressure discharge lamps have a lamp bulb of silica glass with a substantially spherical discharge space defined centrally in its longitudinal direction, and a pair of electrodes of tungsten disposed in the discharge space in confronting relation to each other. The discharge space is filled with mercury, a halogen gas, and an inactive gas. The two electrodes are inserted from respective insertion holes defined in the opposite ends of the lamp bulb. The insertion holes are hermetically sealed by rear portion of the respective electrodes which are covered with respective sheets of molybdenum foil serving as a thermal buffer.

When a trigger voltage is applied between the electrodes, a glow discharge is induced between the electrodes in an inactive gas atmosphere in the discharge space, vaporizing the mercury filled in the discharge space. A plasma discharge is generated in a high-pressure mercury gas atmosphere within the discharge space, emitting highly brilliant light of good color-rendering capability.

When the discharge is caused in the discharge space at a high temperature under a high pressure, the tungsten (W) of the electrodes are vaporized and deposited on the inner surface of the bulb wall which defines the discharge space. The conventional high-pressure discharge lamp is therefore problematic in that the tungsten deposited on the inner surface of the bulb wall blackens the bulb wall, lowering the luminance of the discharge lamp. At present, it is customary to encapsulate a halogen gas into the discharge space to prevent the bulb wall from being blackened. The halogen gas filled in the discharge space produces halogen ions which are combined with the vaporized tungsten and deposits the tungsten on the proximal portions of the electrodes at a relatively low temperature. Such a halogen cycle is repeated to prevent the bulb wall from being blackened.

As described above, the halogen gas is effective to prevent the luminance of the discharge lamp from being lowered due to blackening of the bulb wall. However, if the halogen gas is excessively present in the discharge space, then it tends to erode the electrodes and the molybdenum foil, possibly causing the gas to leak from the lamp bulb and rupturing the lamp bulb. There have been developed various techniques for optimizing the concentration of the halogen gas in the discharge space to simultaneously solve the problem of the reduction of the luminance due to blackening and the problem of gas leakage and lamp bulb rupture (see, for example, Japanese laid-open patent publication No. 11-149899 and Japanese patent No. 2829339).

Today, there are demands for high-pressure discharge lamps of smaller size and higher luminance. To meet these demands, it is necessary to either increase the electric power applied to the high-pressure discharge lamps or increase the amount of mercury filled in the discharge space. If the applied electric power or the filled amount of mercury is increased, then an electric power load (thermal load) on the discharge lamp is increased. The electric power load is called a bulb wall load (L) which is expressed by L=P (the electric power applied to the discharge lamp: W)/S (the inner surface area of the bulb wall which defines the discharge space: $mm^2$). Generally, as the bulb wall load L increases, the discharge lamp exhibits a greater tendency to be quickly deteriorated (blackened, whitened, electrodes consumed, etc.) per unit time. The greatest cause of the deterioration is that the halogen cycle does not function properly. Specifically, the halogen cycle functions properly when halogen gas atoms, whose number of moles is greater than the number of moles of tungsten atoms expelled from the electrodes by the discharge, are present in the discharge space. If the number of moles of halogen gas atoms is smaller than the number of moles of tungsten atoms, then the halogen cycle partly fails to function properly, i.e., tungsten atoms occur which cannot be combined with halogen gas atoms. As a result, those tungsten atoms occur which cannot be combined with halogen gas atoms are deposited on the inner surface of the bulb wall which defines the discharge space, causing blackening of the bulb wall. The blackening of the bulb wall induces a reduction in the transparency of the bulb wall (whitening) and an undue consumption of the electrodes.

SUMMARY OF THE INVENTION

It is an object of the present invention to provide a high-pressure discharge lamp which sufficiently meets demands for smaller-size, higher-luminance high-pressure discharge lamps, and solves the problems of deteriorations such as blackening and whitening of bulb walls, and the problems of gas leakage and lamp bulb rupture.

If a discharge lamp is cooled under the same conditions, the temperature in a discharge space defined in a lamp bulb of the discharge lamp changes depending on the magnitude of bulb wall load L. That is, as bulb wall load L is greater, the temperature of an inner surface of the bulb wall (hereinafter referred to as bulb wall temperature) which defines the discharge space is higher. Generally, the halogen cycle referred to above begins when the bulb wall temperature exceeds 250° C. The halogen effect of each halogen gas is temperature-dependent. Specifically, a chlorine (Cl)-based halogen gas exhibits a good halogen effect in a high temperature range, an iodine (I)-based halogen gas exhibits a good halogen effect in a low temperature range, and a bromine (Br)-based halogen gas exhibits a good halogen effect in a medium temperature range. The halogen cycle becomes more effective as the absolute amount of halogen gases in the discharge space is greater.

The inventor of the present invention has paid attention to the relationship between the temperature-dependency of the halogen effect and the absolute amount of halogen gases, and the halogen cycle, and has made intensity research efforts in order to achieve the above object. As a result of the research, the inventor has completed a high-pressure discharge lamp which properly maintains a halogen cycle irrespective of the magnitude of bulb wall load L and a method of manufacturing such a high-pressure discharge lamp, by determining the type and filled amount of a primary halogen gas based on bulb wall load L which is a standard that is completely different from conventional standards.

Specifically, in a high-pressure discharge lamp according to the present invention, the type and content of a primary halogen gas whose content is the greatest in a mixed halogen gas filled in a discharge space are determined based on a bulb wall load. In a method of manufacturing a high-pressure discharge lamp according to the present invention, the type and content of a primary halogen gas whose content is the greatest in a mixed halogen gas encapsulated in a discharge space are determined based on a bulb wall load, and the lamp bulb is encapsulates the primary halogen gas of the determined type and the determined content separately from, or together with, other halogen gases.

The primary halogen gas should preferably be selected from three halogen gases including an iodine-based halogen gas, a bromine-based halogen gas, and a chlorine-based halogen gas. In addition, for selecting the primary halogen gas, the bulb wall temperature in use is divided into three relative temperature ranges including a low temperature range, a medium temperature range, and a high temperature range. If the bulb wall temperature is in the low temperature range, then the iodine-based halogen gas should preferably be selected as the primary halogen gas. If the bulb wall temperature is in the medium temperature range, then the bromine-based halogen gas should preferably be selected as the primary halogen gas. If the bulb wall temperature is in the high temperature range, then the chlorine-based halogen gas should preferably be selected as the primary halogen gas.

With the high-pressure discharge lamp according to the present invention, and a high-pressure discharge lamp manufactured by the method according to the present invention, the type and content of the primary halogen gas in the mixed halogen gas are determined based on the bulb wall load which changes with the electric power applied to the high-pressure discharge lamp and the amount of mercury filled in the discharge space. More specifically, an appropriate amount of mixed halogen gas containing a primary halogen gas which is most effective under bulb wall load conditions (bulb wall temperature conditions) is encapsulated in the lamp bulb. Since the halogen cycle is properly maintained in the lamp bulb, the high-pressure discharge lamp can solve the problems of various deteriorations of the discharge lamp, such as blackening of the lamp bulb, and the problems of gas leakage and lamp bulb rupture, while meeting demands for smaller-size, higher-luminance high-pressure discharge lamps.

The above and other objects, features, and advantages of the present invention will become apparent from the following description with reference to the accompanying drawings which illustrate examples of the present invention.

DESCRIPTION OF THE PREFERRED EMBODIMENTS

1st Embodiment

Figure 1:
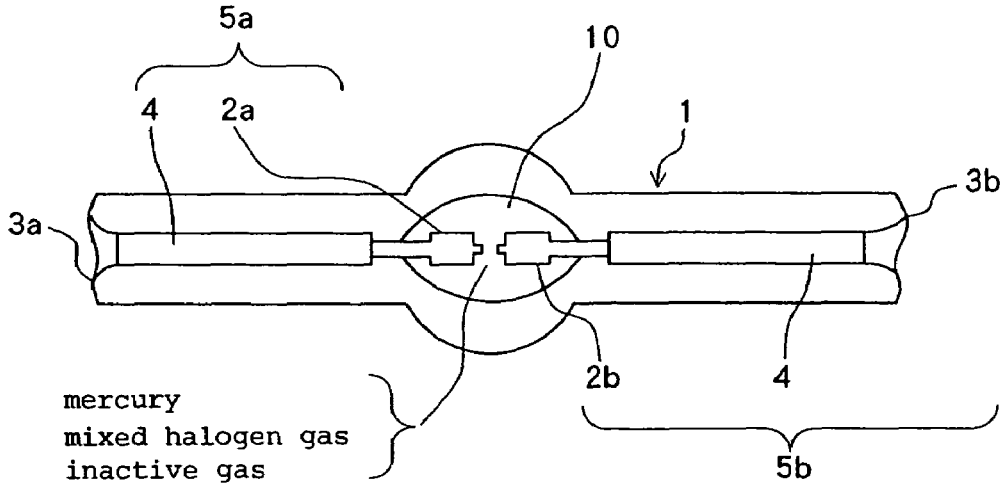
FIG. 1 is a schematic cross-sectional view of a high-pressure discharge lamp according to an embodiment of the present invention.

FIG. 1 shows in schematic cross section a high-pressure discharge lamp according to an embodiment of the present invention. As shown in FIG. 1, the high-pressure discharge lamp has lamp bulb 1 of silica glass with substantially spherical discharge space 10 defined centrally in its longitudinal direction, and a pair of electrodes 2*a*, 2*b* disposed in discharge space 10 in confronting relation to each other. The relationship between inner surface area S (mm$^2$) of the bulb wall defining the discharge space 10 and electric power P (W) applied to the high-pressure discharge lamp is established such that bulb wall load L (W/mm$^2$) is in the range of $0.8 \leqq L < 1.0$.

Electrodes 2*a*, 2*b* are made of tungsten and are inserted from respective insertion holes 3*a*, 3*b* defined in the opposite ends of lamp bulb 1. Insertion holes 3*a*, 3*b* are hermetically sealed by rear portion of respective electrodes 2*a*, 2*b* which are covered with respective sheets of molybdenum foil 4 serving as a thermal buffer. The high-pressure discharge lamp according to the present embodiment is an AC high-pressure discharge lamp, and hence electrodes 2*a*, 2*b* are identical in shape to each other. If the high-pressure discharge lamp is a DC high-pressure discharge lamp, then electrodes 2*a*, 2*b* are different in shape from each other.

Discharge space 10 is evacuated to the extent that the partial pressure oxygen (0) therein is equal to or less than a predetermined value. Discharge space 10 encapsulates mercury (Hg), an inactive gas such as of argon (Ar), or xenon (Xe), and also a mixed halogen gas containing two or more halogen gases. If the bulb wall load L is in the above range, then the bulb wall has a temperature ranging from 700° C. to 850° C. when the high-pressure discharge lamp is in normal usage. This temperature range belongs to the low temperature range referred to above. The mixed halogen gas filled in the discharge space 10 contains a primary halogen gas comprising an iodine-based halogen gas which exhibits a good halogen cycle in the low temperature range and an auxiliary halogen gas comprising a bromine-based halogen gas and/or a chlorine-based halogen gas. The primary halogen gas refers to a halogen gas whose content in the mixed halogen gas is the greatest, and the auxiliary halogen gas refers to a halogen gas whose content in the mixed halogen gas is smaller than the primary halogen gas. In the present embodiment, the mixed halogen gas filled in the discharge space 10 contains an iodine-based halogen gas whose content in the mixed halogen gas ranges from $10^{-8}$ μmol/mm$^3$ to $10^{-6}$ μmol/mm$^3$ and a bromine-based halogen gas and/or a chlorine-based halogen gas whose content in the mixed halogen gas is one digit smaller than the iodine-based halogen gas.

Discharge space 10 is also filled with mercury in the range from 0.12 mg/mm$^3$ to 0.25 mg/mm$^3$ and an inactive gas whose partial pressure ranges from $6.0 \times 10^{-4}$ Pa to $6.0 \times 10^{-3}$ Pa, in addition to the mixed halogen gas.

Figure 2:
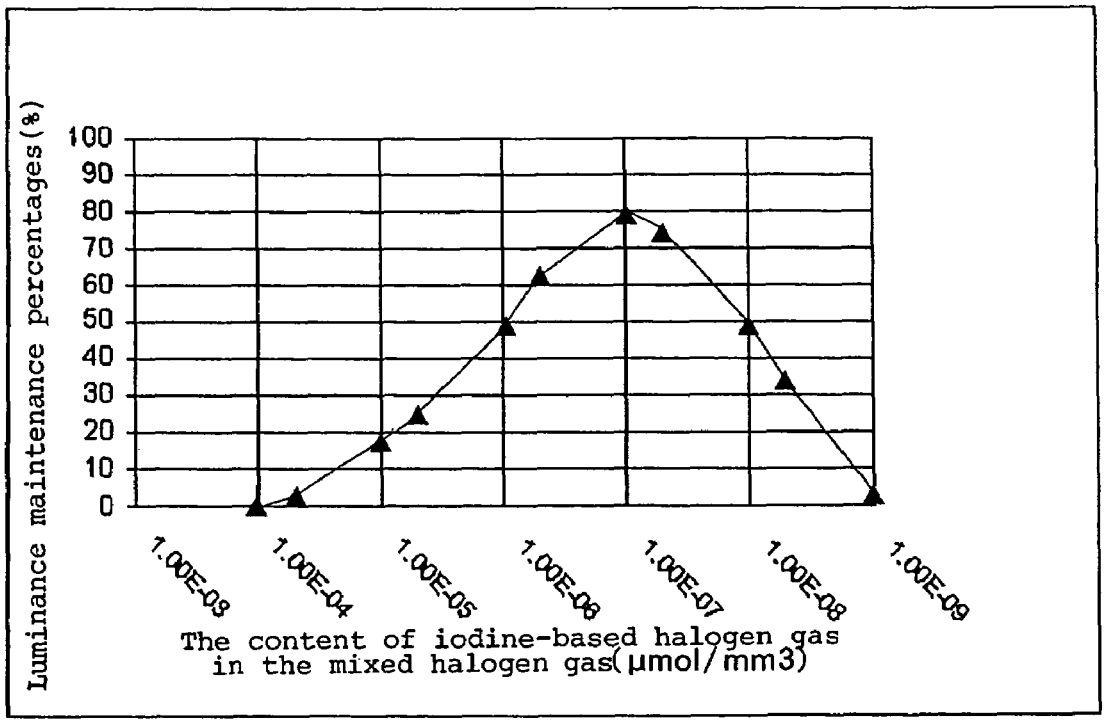
FIG. 2 is a diagram showing luminance maintenance percentages measured at the time bulb wall load L was in the range of $0.8 \leqq L < 1.0$ and the content of an iodine-based halogen gas in a mixed halogen gas was changed from $10^{-4}$ μmol/mm$^3$ to $10^{-9}$ μmol/mm$^3$.

Luminance maintenance percentages of the high-pressure discharge lamp according to the present embodiment, which were measured when bulb wall load L (W/mm$^2$) was in the range of $0.8 \leqq L < 1.0$ and the content of the iodine-based halogen gas in the mixed halogen gas was changed from $10^{-4}$ μmol/mm$^3$ to $10^{-9}$ μmol/mm$^3$ are shown in FIG. 2. It can be seen from FIG. 2 that the luminance maintenance percentage was equal to or higher than 50% at all times when bulb wall load L (W/mm$^2$) was in the range of $0.8 \leqq L$ <1.0 and the content of the iodine-based halogen gas as the primary halogen gas was in the range from $10^{-8}$ μmol/mm$^3$ to $10^{-6}$ μmol/mm$^3$.

The high-pressure discharge lamp shown in FIG. 1 can be manufactured according a process shown in FIG. 3 as follows:

(1) Lamp Bulb Forming Step:

A tube of silica glass having a predetermined length is shaped in its longitudinal portion into a substantially spherical form, producing lamp bulb 1.

(2) Electrode Assembling Step:

Electrodes 2*a*, 2*b* of tungsten are covered with respective sheets of molybdenum foil 4, producing electrode assemblies 5*a*, 5*b*.

(3) Pre-Annealing Step:

Lamp bulb 1 and electrode assemblies 5*a*, 5*b* are pre-annealed by being heated in a vacuum at 1800° C. for two hours.

(4) Electrode Installing Step 1:

Electrode assembly 5*a* is inserted into insertion hole 3*a* in lamp bulb 1. Thereafter, the entire assembly is heated in a vacuum at a high temperature (e.g., 1600° C.) for a predetermined time (e.g., 10 minutes), sealing insertion hole 3*a*.

(5) Evacuating Step:

Oxygen is discharged from other insertion hole 3*b* in lamp bulb 1 until the partial pressure of oxygen in lamp bulb 1 reaches a predetermined value (e.g., $2.0\times10^{-3}$ Pa).

(6) Mercury Introducing Step:

Mercury in the range from 0.12 mg/mm$^3$ to 0.25 mg/mm$^3$ is introduced from insertion hole 3*b* into lamp bulb 1.

(7) Primary Halogen Gas Introducing Step:

An iodine-based halogen gas whose content in the mixed halogen gas ranges from $10^{-8}$ μmol/mm$^3$ to $10^{-6}$ μmol/mm$^3$ is introduced from insertion hole 3*b* into lamp bulb 1. If the preset bulb wall load L is higher, then the content of the iodine-based halogen gas is increased in the above range. If the preset bulb wall load L is lower, then the content of the iodine-based halogen gas is reduced in the above range.

(8) Auxiliary Halogen Gas Introducing Step:

A predetermined amount of bromine-based halogen gas and/or chlorine-based halogen gas is introduced from insertion hole 3*b* into lamp bulb 1. The introduced amount of bromine-based halogen gas and/or chlorine-based halogen gas is such that the content thereof in the mixed halogen gas is-one digit smaller than the iodine-based halogen gas.

(9) Inactive Gas Introducing Step:

An inactive gas in an amount whose partial pressure ranges from $6.0\times10^{-3}$ Pa to $6.0\times10^{-4}$ Pa is introduced from insertion hole 3*b* into lamp bulb 1.

(10) Electrode Installing Step 2:

Electrode assembly 5*b* is inserted into insertion hole 3*b* in lamp bulb 1. Thereafter, the entire assembly is heated in a vacuum at a high temperature (e.g., 1600° C.) for a predetermined time (e.g., 10 minutes), sealing insertion hole 3*b* thereby to form discharge space 10.

The steps after the evacuating step are performed while the partial pressure of oxygen after the evacuating step is being maintained. When a gas is introduced into lamp bulb 1 in a certain step, it is introduced so that the mercury or other gases introduced in previous steps will not leak out of insertion hole 3*b*. The mercury introducing step, the primary halogen gas introducing step, the auxiliary halogen gas introducing step, and the inactive gas introducing step may be switched around in their order. The primary halogen gas, the auxiliary halogen gas, and the inactive gas may be partly or wholly mixed in advance or may simultaneously be introduced into lamp bulb 1, so that one or more of the above steps may be dispensed with.

2nd Embodiment

A high-pressure discharge lamp according to a second embodiment of the present invention will be described below. The high-pressure discharge lamp according to the second embodiment has a basic structure identical to that of the high-pressure discharge lamp shown in FIG. 1. Only those portions of the high-pressure discharge lamp according to the second embodiment which are different from the high-pressure discharge lamp shown in FIG. 1 will be described below.

According to the second embodiment, the relationship between inner surface area S (mm$^2$) of the bulb wall defining the discharge space and electric power P (W) applied to the high-pressure discharge lamp is established such that bulb wall load L (W/mm$^2$) is in the range of $1.0\leqq L<1.2$. If the bulb wall load L is in the above range, then the bulb wall has a temperature ranging from 850° C. to 1000° C. when the high-pressure discharge lamp is in normal usage. This temperature range belongs to the medium temperature range referred to above. The mixed halogen gas filled in the discharge space contains a primary halogen gas comprising a bromine-based halogen gas which exhibits a good halogen cycle in the medium temperature range and an auxiliary halogen gas comprising an iodine-based halogen gas and/or a chlorine-based halogen gas. More specifically, the mixed halogen gas filled in the discharge space contains a bromine-based halogen gas whose content in the mixed halogen gas ranges from $10^{-7}$ μmol/mm$^3$ to $10^{-5}$ μmol/mm$^3$ and an iodine-based halogen gas and/or a chlorine-based halogen gas whose content in the mixed halogen gas is one digit smaller than the bromine-based halogen gas.

Figure 3:
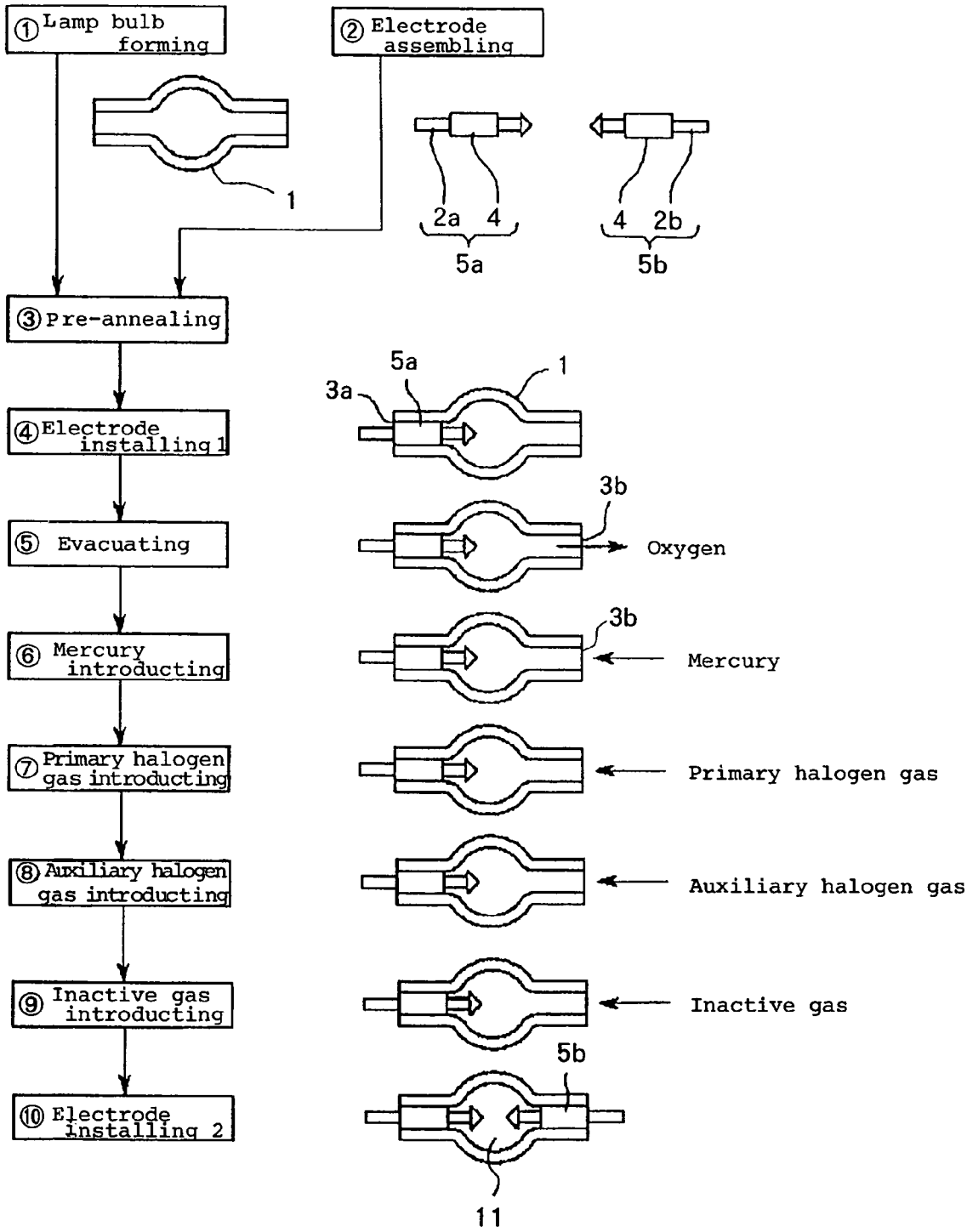
FIG. 3 is a diagram illustrative of a process of manufacturing the high-pressure discharge lamp according to the present invention.

The high-pressure discharge lamp according to the second embodiment can be manufactured according to a process which is basically the same as the manufacturing process shown in FIG. 3 except that the types and amounts of halogen gas to be introduced into the lamp bulb are to be changed as described above.

Figure 4:
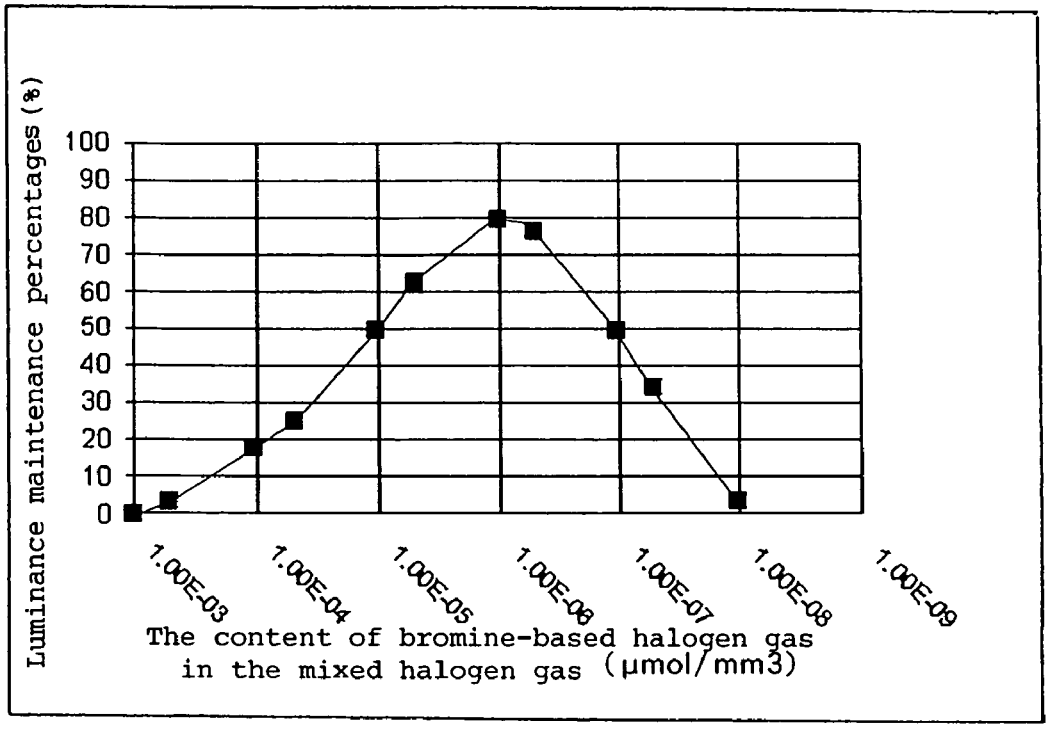
FIG. 4 is a diagram showing luminance maintenance percentages measured at the time bulb wall load L was in the range of $1.0 \leqq L < 1.2$ and the content of a bromine-based halogen gas in a mixed halogen gas was changed from $10^{-3}$ μmol/mm$^3$ to $10^{-8}$ μmol/mm$^3$.

Luminance maintenance percentages of the high-pressure discharge lamp according to the present embodiment, which were measured when bulb wall load L (W/mm$^2$) was in the range of $1.0\leqq L<1.2$ and the content of the bromine-based halogen gas in the mixed halogen gas was changed from $10^{-3}$ μmol/mm$^3$ to $10^{-8}$ μmol/mm$^3$ are shown in FIG. 4. It can be seen from the graph shown in FIG. 4 that the luminance maintenance percentage was equal to or higher than 50% at all times when bulb wall load L (W/mm$^2$) was in the range of $1.0\leqq L<1.2$ and the content of the bromine-based halogen gas as the primary halogen gas was in the range from $10^{-7}$ μmol/mm$^3$ to $10^{-5}$ μmol/mm$^3$.

3rd Embodiment

A high-pressure discharge lamp according to a third embodiment of the present invention will be described below. The high-pressure discharge lamp according to the third embodiment has a basic structure identical to that of the high-pressure discharge lamp shown in FIG. 1. Only those portions of the high-pressure discharge lamp according to the third embodiment which are different from the high-pressure discharge lamp shown in FIG. 1 will be described below.

According to the third embodiment, the relationship between inner surface area S ($mm^2$) of the bulb wall defining the discharge space and electric power P (W) applied to the high-pressure discharge lamp is established such that bulb wall load L ($W/mm^2$) is in the range of $1.2 \leqq L < 1.4$. If the bulb wall load L is in the above range, then the bulb wall has a temperature ranging from 1000° C. to 1150° C. when the high-pressure discharge lamp is in normal usage. This temperature range belongs to the high temperature range referred to above. The mixed halogen gas filled in the discharge space contains a primary halogen gas comprising a chlorine-based halogen gas which exhibits a good halogen cycle in the high temperature range and an auxiliary halogen gas comprising an iodine-based halogen gas and/or a bromine-based halogen gas. More specifically, the mixed halogen gas filled in the discharge space contains a chlorine-based halogen gas whose content in the mixed halogen gas ranges from $10^{-6}$ μmol/$mm^3$ to $10^{-4}$ μmol/$mm^3$ and an iodine-based halogen gas and/or a bromine-based halogen gas whose content in the mixed halogen gas is one digit smaller than the chlorine-halogen gas.

The high-pressure discharge lamp according to the third embodiment can be manufactured according to a process which is basically the same as the manufacturing process shown in FIG. 3 except that the types and amounts of halogen gas to be introduced into the lamp bulb are to be changed as described above.

Figure 5:
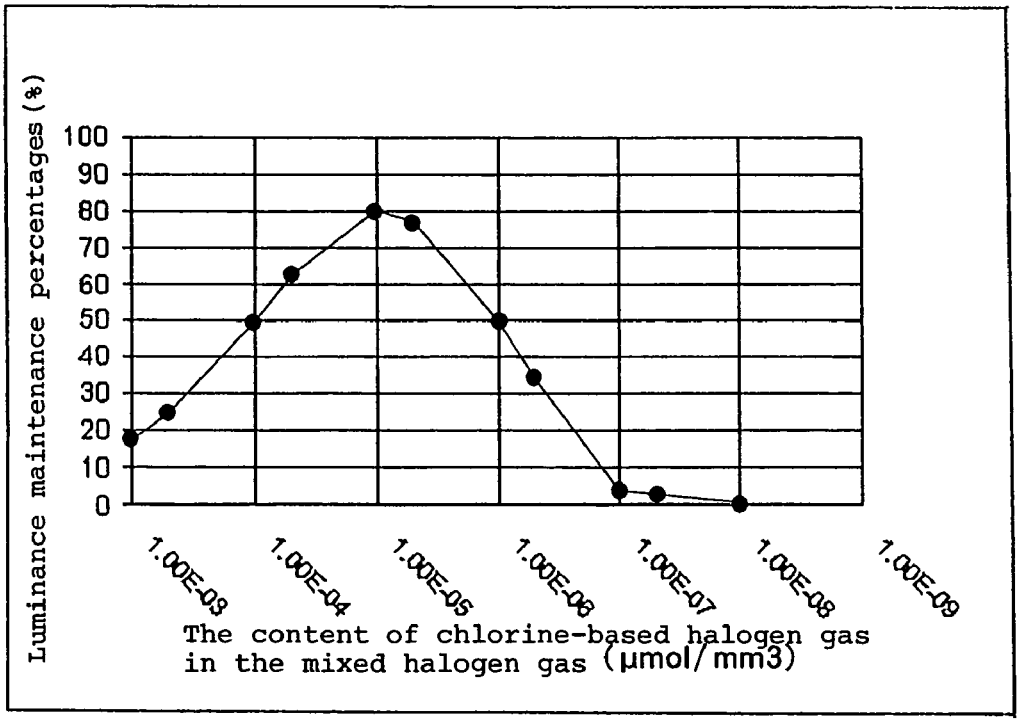
FIG. 5 is a diagram showing luminance maintenance percentages measured at the time bulb wall load L was in the range of $1.2 \leqq L \leqq 1.4$ and the content of a chlorine-based halogen gas in a mixed halogen gas was changed from $10^{-3}$ μmol/mm$^3$ to $10^{-8}$ μmol/mm$^3$.

Luminance maintenance percentages of the high-pressure discharge lamp according to the present embodiment, which were measured when bulb wall load L ($W/mm^2$) was in the range of $1.2 \leqq L \leqq 1.4$ and the content of the chlorine-based halogen gas in the mixed halogen gas was changed from $10^{-3}$ μmol/$mm^3$ to $10^{-8}$ μmol/$mm^3$ are shown in FIG. 5. It can be seen from the graph shown in FIG. 5 that the luminance maintenance percentage was equal to or higher than 50% at all times when bulb wall load L ($W/mm^2$) was in the range of $1.2 \leqq L \leqq 1.4$ and the content of the chlorine-based halogen gas as the primary halogen gas was in the range from $10^{-6}$ μmol/$mm^3$ to $10^{-4}$ μmol/$mm^3$.

While preferred embodiments of the present invention have been described using specific terms, such description is for illustrative purposes only, and it is to be understood that changes and variations may be made without departing from the spirit or scope of the following claims.

What is claimed is:

1. A high-pressure discharge lamp comprising:

a lamp bulb of silica glass encapsulating mercury, an inactive gas, and a mixed halogen gas containing at least two halogen gases, and at least a pair of electrodes disposed in said lamp bulb in confronting relation to each other, wherein said mixed halogen gas contains at least one of an iodine-based halogen gas, a bromine-based halogen gas, and a chlorine-based halogen gas, and a type and content of a primary halogen gas whose content is the greatest in said mixed halogen gas are determined based on a bulb wall load, wherein said bulb wall load L ($W/mm^2$) is in a range of $0.8 \leqq L < 1.0$, said primary halogen gas comprises the iodine-based halogen gas, and the content of the iodine-based halogen gas in said mixed halogen gas is in a range from $10^{-8}$ μmol/$mm^3$ to $10^{-6}$ μmol/$mm^3$.

2. A high-pressure discharge lamp comprising:

a lamp bulb of silica glass encapsulating mercury, an inactive gas, and a mixed halogen gas containing at least two halogen gases, and at least a pair of electrodes disposed in said lamp bulb in confronting relation to each other, wherein said mixed halogen gas contains at least one of an iodine-based halogen gas, a bromine-based halogen gas, and a chlorine-based halogen gas, and a type and content of a primary halogen gas whose content is the greatest in said mixed halogen gas are determined based on a bulb wall load, wherein said bulb wall load L ($W/mm^2$) is in a range of $1.2 \leqq L \leqq 1.4$, said primary halogen gas comprises the chlorine-based halogen gas, and the content of the chlorine-halogen gas in said mixed halogen gas is in a range from $10^{-6}$ μmol/$mm^3$ to $10^{-4}$ μmol/$mm^3$.

* * * * *